US007124990B1

(12) United States Patent
Sanathra

(10) Patent No.: US 7,124,990 B1
(45) Date of Patent: Oct. 24, 2006

(54) POTATO CHIP BAG HOLDER

(76) Inventor: Mahendra Sanathra, 5340 La Fiesta St., Yorba Linda, CA (US) 92887

( * ) Notice: Subject to any disclaimer, the term of this patent is extended or adjusted under 35 U.S.C. 154(b) by 0 days.

(21) Appl. No.: 10/945,142

(22) Filed: Sep. 20, 2004

Related U.S. Application Data

(60) Provisional application No. 60/504,559, filed on Sep. 18, 2003.

(51) Int. Cl.
*A47K 1/08* (2006.01)
*B65D 25/00* (2006.01)

(52) U.S. Cl. ..... 248/311.2; 206/737; 248/686; D19/75

(58) Field of Classification Search ..... 248/686, 248/687, 910, 311.2; 211/40, 194; D21/498, D21/499, 484; D7/703; D11/145; D9/519; D19/910, 75; 40/764, 607.1, 608
See application file for complete search history.

(56) References Cited

U.S. PATENT DOCUMENTS 2,341,092 A * 2/1944 Gooden ..... 131/242
3,955,510 A * 5/1976 Kinik et al. ..... 108/192
3,967,407 A * 7/1976 Halbasch ..... 43/44.9
4,124,958 A * 11/1978 Chiche ..... 312/140
4,221,293 A * 9/1980 Anthony ..... 206/494
4,616,571 A * 10/1986 Lange ..... 108/60
5,573,019 A * 11/1996 Hempel ..... 132/310
5,784,950 A * 7/1998 Kayukawa et al. ..... 92/71
D400,620 S * 11/1998 Barton, Jr. ..... D21/713
D413,931 S * 9/1999 Ancona et al. ..... D19/90
6,457,604 B1 * 10/2002 McNabb ..... 220/737
6,543,777 B1 * 4/2003 Carbonero ..... 273/407
6,669,526 B1 * 12/2003 Manville et al. ..... 446/113
D489,412 S * 5/2004 Hsu ..... D19/75

* cited by examiner

*Primary Examiner*—Amy J Sterling
*Assistant Examiner*—Tan Le
(74) *Attorney, Agent, or Firm*—Kenneth L Tolar

(57) ABSTRACT

A device for supporting a potato chip bag in an upright position includes a semispherical base member having a rounded bottom portion and a substantially planar top portion. The rounded bottom portion is weighted to ballast the base member in an upright position. A pair of intersecting slots are provided on the top surface, each dimensioned to tightly receive a particular size potato chip bag. A pair of opposing sidewalls define each slot, each of which include a plurality of interspersed nodules thereon for frictionally engaging the exterior surface of the potato chip bag.

3 Claims, 1 Drawing Sheet

POTATO CHIP BAG HOLDER

CROSS REFERENCE TO RELATED APPLICATIONS

This application is entitled to the benefit of provisional application No. 60/504,559 filed on Sep. 18, 2003.

BACKGROUND OF THE INVENTION

The present invention relates to a device for conveniently retaining a potato chip bag in an upright position.

DESCRIPTION OF THE PRIOR ART

Many people consume potato chips while engaging in various activities such as watching TV, playing video games or reading. Because such bags are substantially flat, they cannot stand upright. When the potato chip bag is lying flat on a table or other surface, it is susceptible to being struck by other objects thereby crushing the chips inside. Though a bag can be propped upright by an object, it is difficult to access and is susceptible to toppling. The present invention addresses these problems by providing a device that conveniently supports a potato chip bag in an upright position while allowing a user to temporarily lower the top end of the bag to retrieve a chip from within. When the bag is released, the device automatically repositions the bag in an upright position.

SUMMARY OF THE INVENTION

The present invention relates to a device for conveniently supporting a potato chip bag in an upright position. The device comprises a semispherical base member having a rounded bottom surface and a substantially planar upper surface. Embedded within the lower surface is a weight for ballasting the base in an upright position. On the top surface of the base member are a pair of intersecting slots, each for receiving the lower end of a potato chip bag. Each slot is defined by a pair of opposing side walls, each having a plurality of interspersed nodules thereon. The nodules frictionally engage the exterior surface of the potato chip bag to prevent the bag from sliding or shifting. A first slot is sized to tightly accommodate a smaller potato chip bag while a second slot is sized to tightly accommodate a larger potato chip bag.

To use the above described device, a user inserts the lower end of a potato chip bag into the appropriate slot at which time the bag will be supported in an upright position. If a user wishes to retrieve a chip from the bag, he or she inserts a hand into the bag and pivots the upper end of the bag downwardly and retrieves a chip. When the user removes his or her hand from the bag, the ballast will cause the base component and bag to pivot upwardly to their original upright positions.

It is therefore an object of the present invention to provide a device that allows a user to securely support a potato chip bag in an upright position.

It is another object of the present invention to provide a device for supporting a potato chip bag that allows a user to temporarily lower the upper end of the bag to retrieve a potato chip.

It is yet another object of the present invention to provide a potato chip bag holder that is configured to retain varying size bags. Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
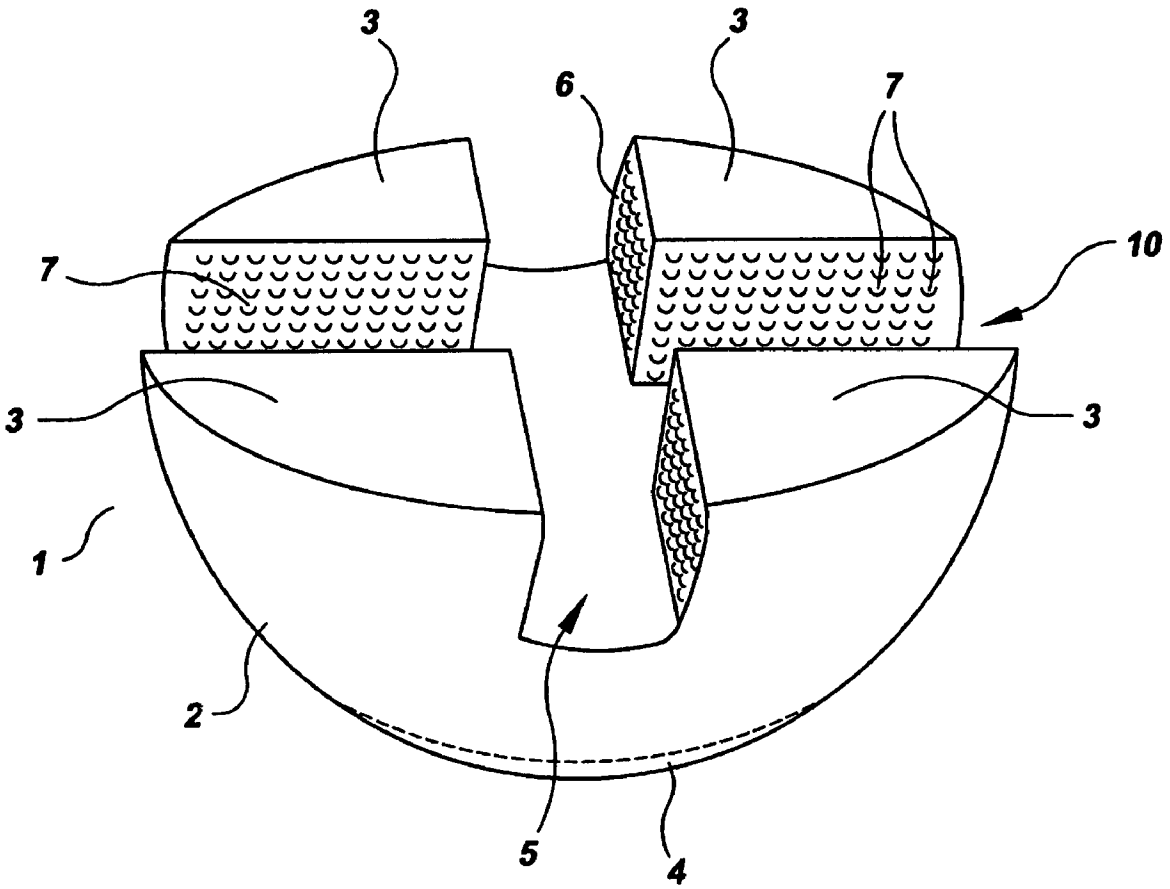
FIG. 1 is a perspective view of the device.

The present invention relates to a device for conveniently supporting a potato chip bag in an upright position. The device comprises a semispherical base member 1 having a rounded bottom surface 2 and a substantially planar upper surface 3. Embedded within the lower surface is a weight 4 for ballasting the base member in an upright position.

On the top surface of the base member are a pair of intersecting slots 5, 10 each for receiving the lower end of a potato chip bag. Each slot is defined by a pair of opposing sidewalls 6, each having a plurality of interspersed nodules 7 thereon for frictionally engaging the exterior surface of the potato chip bag; the nodules prevent the bag from sliding or shifting. A first slot 5 is sized to tightly receive a smaller potato chip bag while a second slot 10 is sized to tightly receive a larger potato chip bag.

To use the above described device, a user inserts the lower end of a potato chip bag into the appropriate slot at which time the bag will be supported in an upright position. If a user wishes to retrieve a chip from the bag, he or she inserts a hand into the bag and pivots the upper end of the bag downwardly and retrieves a chip. When the user removes his or her hand from the bag, the ballast will cause the base component and bag to pivot upwardly to their original, upright positions.

The above described device is not limited to the exact details of construction and arrangement of parts provided herein. Furthermore, the size, shape and materials of construction of the various components can be varied.

Although there has been shown and described the preferred embodiment of the present invention, it will be readily apparent to those skilled in the art that modifications may be made thereto which do not exceed the scope of the amended claims. Therefore, the scope of the invention is limited only by the following claims.

What is claimed is:

1. A potato clip bag holder comprising:

a semispherical base component having a rounded lower surface and a substantially planar upper surface;

a pair of perpendicularly intersecting slots formed on the upper surface of said base component, the slots having a depth, the depth of the slots being disposed on the planar upper surface of the semispherical base, each slot for receiving a lower edge of a potato chip bag to support the potato chip bag in an upright position.

a weight embedded within the rounded lower surface of said base component for ballasting the upper surface of said base component in a substantially horizontal orientation.

2. The potato chip bag holder according to claim 1 wherein said slots are formed of a pair of spaced sidewalls, each having a plurality of nodules interspersed thereon for frictionally engaging a potato chip bag exterior.

3. The potato chip bag holder according to claim 1 wherein each of said slots has a discrete dimension for retaining varying size potato chip bags.

* * * * *